US008594350B2

(12) United States Patent
Hooley et al.

(10) Patent No.: US 8,594,350 B2
(45) Date of Patent: Nov. 26, 2013

(54) SET-UP METHOD FOR ARRAY-TYPE SOUND SYSTEM

(75) Inventors: Anthony Hooley, Cambridge (GB); Paul Thomas Troughton, Cambridge (GB); David Charles William Richards, Cambridge (GB); David Christopher Turner, Edge (GB)

(73) Assignee: Yamaha Corporation, Hamamatsu-shi, Shizuoka-ken (JP)

( * ) Notice: Subject to any disclaimer, the term of this patent is extended or adjusted under 35 U.S.C. 154(b) by 2332 days.

(21) Appl. No.: 10/540,255

(22) PCT Filed: Jan. 19, 2004

(86) PCT No.: PCT/GB2004/000160

§ 371 (c)(1),
(2), (4) Date: Dec. 8, 2005

(87) PCT Pub. No.: WO2004/066673

PCT Pub. Date: Aug. 5, 2004

(65) Prior Publication Data

US 2006/0153391 A1 Jul. 13, 2006

(30) Foreign Application Priority Data

Jan. 17, 2003 (GB) ..... 0301093.1

(51) Int. Cl.
*H04R 5/02* (2006.01)

(52) U.S. Cl.
USPC ..... 381/307; 381/59; 381/92; 381/150

(58) Field of Classification Search
USPC ..... 381/56, 307, 300, 1, 58, 59, 303, 150, 381/116, 91, 61, 92
See application file for complete search history.

(56) References Cited

U.S. PATENT DOCUMENTS

| | | | | |
|---|---|---|---|---|
| 3,453,871 | A * | 7/1969 | Krautkramer | 73/602 |
| 3,992,586 | A | 11/1976 | Jaffe | |
| 3,996,561 | A | 12/1976 | Kowal et al. | |
| 4,042,778 | A | 8/1977 | Clinton et al. | |
| 4,190,739 | A | 2/1980 | Torffield | |

(Continued)

FOREIGN PATENT DOCUMENTS

| | | |
|---|---|---|
| DE | 966384 | 8/1957 |
| EP | 0 521 655 | 1/1993 |

(Continued)

OTHER PUBLICATIONS

Johan Van Der Werff "Design and Implementation of a Sound Column With Exceptional Properties"; Preprint of 96$^{th}$ AES Convention, Amsterdam; No. 3835; Feb. 26, 2004. XP007901141.

(Continued)

*Primary Examiner* — Vivian Chin
*Assistant Examiner* — Con P Tran
(74) *Attorney, Agent, or Firm* — Nixon & Vanderhye, P.C.

(57) ABSTRACT

An example set-up method for a loudspeaker system capable of generating at least one directed beam of audio sound includes emitting directional beams of set-up sound signals from the loudspeaker system into a room, registering at least one reflection of the emitted signals at one or more locations within the room, and evaluating the registered reflected signals to obtain data for use in configuring the surround sound system.

46 Claims, 8 Drawing Sheets

(56) References Cited

U.S. PATENT DOCUMENTS

| | | | | |
|---|---|---|---|---|
| 4,256,922 | A | 3/1981 | Gorike | |
| 4,283,600 | A | 8/1981 | Cohen | |
| 4,305,296 | A | 12/1981 | Green et al. | |
| 4,330,691 | A | 5/1982 | Gordon | |
| 4,332,018 | A | 5/1982 | Sternberg et al. | |
| 4,388,493 | A | 6/1983 | Maisel | |
| 4,399,328 | A | 8/1983 | Franssen et al. | |
| 4,472,834 | A | 9/1984 | Yamamuro et al. | |
| 4,515,997 | A | 5/1985 | Stinger, Jr. | |
| 4,518,889 | A | 5/1985 | 'T Hoen | |
| 4,653,505 | A | 3/1987 | Iinuma | |
| 4,769,848 | A | 9/1988 | Eberbach | |
| 4,773,096 | A | 9/1988 | Kim | |
| 4,972,381 | A | 11/1990 | Mitchell et al. | |
| 4,980,871 | A | 12/1990 | Sieber et al. | |
| 4,984,273 | A | 1/1991 | Aylward et al. | 381/1 |
| 5,051,799 | A | 9/1991 | Paul et al. | |
| 5,109,416 | A | 4/1992 | Croft | |
| 5,131,051 | A | 7/1992 | Kishinaga et al. | |
| 5,166,905 | A | 11/1992 | Currie | |
| 5,227,591 | A | 7/1993 | Tarkkonen | |
| 5,233,664 | A | 8/1993 | Yanagawa et al. | |
| 5,287,531 | A | 2/1994 | Rogers, Jr. et al. | |
| 5,313,172 | A | 5/1994 | Vagher | |
| 5,313,300 | A | 5/1994 | Rabile | |
| 5,438,624 | A | 8/1995 | Lewiner et al. | |
| 5,488,956 | A | 2/1996 | Bartelt et al. | |
| 5,491,754 | A | 2/1996 | Jot et al. | |
| 5,517,200 | A | 5/1996 | McAdam et al. | |
| 5,555,306 | A | 9/1996 | Gerzon | |
| 5,742,690 | A | 4/1998 | Edgar | |
| 5,745,435 | A | 4/1998 | Fage et al. | |
| 5,751,821 | A | 5/1998 | Smith | 381/90 |
| 5,763,785 | A | 6/1998 | Chiang | |
| 5,802,190 | A | 9/1998 | Ferren | |
| 5,809,150 | A | 9/1998 | Eberbach | |
| 5,822,438 | A | 10/1998 | Sekine et al. | |
| 5,832,097 | A | 11/1998 | Armstrong et al. | |
| 5,834,647 | A | 11/1998 | Gaudriot et al. | |
| 5,841,394 | A | 11/1998 | Sterns et al. | |
| 5,859,915 | A | 1/1999 | Norris | |
| 5,867,123 | A | 2/1999 | Geyh et al. | |
| 5,870,484 | A | 2/1999 | Greenberger | |
| 5,885,129 | A | 3/1999 | Norris | |
| 5,963,432 | A | 10/1999 | Crowley | |
| 6,002,776 | A | 12/1999 | Bhadkamkar et al. | |
| 6,005,642 | A | 12/1999 | Meisner et al. | |
| 6,041,127 | A * | 3/2000 | Elko | 381/92 |
| 6,084,974 | A | 7/2000 | Niimi | |
| 6,112,847 | A | 9/2000 | Lehman | |
| 6,122,223 | A | 9/2000 | Hossack | |
| 6,128,395 | A | 10/2000 | De Vries et al. | |
| 6,154,553 | A | 11/2000 | Taylor | 381/332 |
| 6,169,806 | B1 | 1/2001 | Kimura et al. | |
| 6,243,476 | B1 | 6/2001 | Gardner | |
| 6,263,083 | B1 | 7/2001 | Weinreich | |
| 6,294,905 | B1 | 9/2001 | Schwartz | |
| 6,373,955 | B1 | 4/2002 | Hooley | |
| 6,556,682 | B1 | 4/2003 | Gilloire et al. | |
| 6,807,281 | B1 | 10/2004 | Sasak et al. | |
| 6,834,113 | B1 | 12/2004 | Liljehag et al. | |
| 6,856,688 | B2 | 2/2005 | Cromer et al. | |
| 6,967,541 | B2 | 11/2005 | Hooley | |
| 7,092,541 | B1 | 8/2006 | Eberbach | 381/300 |
| 7,158,643 | B2 | 1/2007 | Lavoie et al. | |
| 7,215,788 | B2 | 5/2007 | Hooley et al. | |
| 7,319,641 | B2 | 1/2008 | Goudie et al. | |
| 7,577,260 | B1 | 8/2009 | Hooley et al. | |
| 2001/0007591 | A1 | 7/2001 | Pompei | |
| 2001/0012369 | A1 | 8/2001 | Marquiss | |
| 2001/0038702 | A1 | 11/2001 | Lavoie et al. | |
| 2001/0043652 | A1 | 11/2001 | Hooley | |
| 2002/0091203 | A1 | 7/2002 | Van Benthem et al. | 525/419 |
| 2002/0126854 | A1 | 9/2002 | Norris et al. | |
| 2002/0131608 | A1 | 9/2002 | Lobb et al. | |
| 2002/0159336 | A1 | 10/2002 | Brown et al. | 367/138 |
| 2003/0091203 | A1 | 5/2003 | Croft, III et al. | |
| 2003/0159569 | A1 * | 8/2003 | Ohta | 84/630 |
| 2004/0151325 | A1 | 8/2004 | Hooley et al. | |
| 2004/0264707 | A1 | 12/2004 | Yang et al. | |
| 2005/0041530 | A1 | 2/2005 | Goudie et al. | |
| 2005/0089182 | A1 | 4/2005 | Troughton et al. | |
| 2005/0207590 | A1 | 9/2005 | Niehoff et al. | |
| 2005/0265558 | A1 | 12/2005 | Neoran | |
| 2006/0153391 | A1 | 7/2006 | Hooley et al. | |
| 2006/0204022 | A1 | 9/2006 | Hooley et al. | |
| 2007/0154019 | A1 | 7/2007 | Kim | |
| 2007/0223763 | A1 | 9/2007 | Bienek et al. | |
| 2007/0269071 | A1 | 11/2007 | Hooley et al. | |
| 2008/0159571 | A1 | 7/2008 | Hooley et al. | |
| 2009/0161880 | A1 | 6/2009 | Hooley et al. | |

FOREIGN PATENT DOCUMENTS

| | | |
|---|---|---|
| EP | 1199907 | 4/2002 |
| EP | 1 348 954 | 10/2003 |
| GB | 2 077 552 | 12/1981 |
| GB | 2 094 101 | 9/1982 |
| GB | 2 303 019 | 2/1997 |
| GB | 2 333 842 | 8/1999 |
| JP | 57 068991 | 4/1982 |
| JP | 02 142285 | 5/1990 |
| JP | 02 257798 | 10/1990 |
| JP | 03 169200 | 7/1991 |
| JP | 04 132499 | 5/1992 |
| JP | 5-103391 | 4/1993 |
| JP | 05 191898 | 7/1993 |
| JP | 05 199598 | 8/1993 |
| JP | 06 038289 | 2/1994 |
| JP | 6-261385 | 9/1994 |
| JP | 07 193896 | 7/1995 |
| JP | 08 051690 | 2/1996 |
| JP | 08 181962 | 7/1996 |
| JP | 10 091390 | 4/1998 |
| JP | 10-285683 | 10/1998 |
| JP | 11-239400 | 8/1999 |
| JP | 2000 023300 | 1/2000 |
| JP | 2000 217197 | 8/2000 |
| JP | 2001 078290 | 3/2001 |
| JP | 2003-510924 | 3/2003 |
| JP | 2003-143686 | 5/2003 |
| WO | 95 20214 | 7/1995 |
| WO | 97 35300 | 9/1997 |
| WO | 99 41943 | 8/1999 |
| WO | 01 08449 | 2/2001 |
| WO | 01/23104 | 4/2001 |
| WO | 01/23104 A | 4/2001 |
| WO | 01 52437 | 7/2001 |
| WO | 02/078388 A | 10/2002 |
| WO | 2004 066673 | 8/2004 |
| WO | 2004/075601 | 9/2004 |
| WO | 2005 027514 | 3/2005 |
| WO | 2005 086526 | 9/2005 |
| WO | 2006 005938 | 1/2006 |
| WO | 2006 005948 | 1/2006 |
| WO | 2006 016156 | 2/2006 |
| WO | 2006 030198 | 3/2006 |
| WO | 2007 007083 | 1/2007 |

OTHER PUBLICATIONS

U.S. Appl. No. 10/089,025, filed Mar. 26, 2002.
U.S. Appl. No. 11/632,440, filed Jan. 12, 2007.
U.S. Appl. No. 11/632,438, filed Jan. 12, 2007.
Troughton "Convenient Multi-Channel Sound in the Home"; 17th Audio Engineering Society Conference. 2002; pp. 102-105.
International Search Report of PCT/GB2004/000160, mailed May 7, 2004.

* cited by examiner

SET-UP METHOD FOR ARRAY-TYPE SOUND SYSTEM

This application is the US national phase of international application PCT/GB2004/000160, filed 19 Jan. 2004, which designated the U.S. and claims benefit of GB 0301093.1, dated 17 Jan. 2003, the entire contents of each of which are hereby incorporated by reference.

FIELD OF THE INVENTION

This invention concerns a device including an array of acoustic transducers capable of receiving an audio input signal and producing beams of audible sound, at a level suitable for home entertainment or professional sound reproduction applications. More specifically, the invention relates to methods and systems for configuring (i.e. setting up) such devices.

BACKGROUND OF THE INVENTION

The commonly-owned International Patent applications no. WO 01/23104 and WO 02/078388, the disclosure of which is hereby incorporated by reference, describe an array of transducers and their use to achieve a variety of effects. They describe methods and apparatus for taking an input signal, replicating it a number of times and modifying each of the replicas before routing them to respective output transducers such that a desired sound field is created. This sound field may comprise, inter alia, a directed, steerable beam, focussed beam or a simulated origin. The methods and apparatus of the above and other related applications is referred to in the following as "Sound Projector" technology.

Conventional surround-sound is generated by placing loudspeakers at appropriate positions surrounding the listener's position (also known as the "sweet-spot"). Typically, a surround-sound system employs a left, centre and right speaker located in the front halfspace and two rear speakers in the rear halfspace. The terms "front", "left", "centre", "right" and "rear" are used relative to the listener's position and orientation. A subwoofer is also often provided, and it is usually specified that the subwoofer can be placed anywhere in the listening environment.

A surround-sound system decodes the input audio information and uses the decoded information to distribute the signal among different channels with each channel usually being emitted through one loudspeaker or a combination of two speakers. The audio information can itself comprise the information for each of the several channels (as in Dolby Surround 5.1) or for only some of the channels, with other channels being simulated (as in Dolby Pro Logic Systems).

In the commonly-owned published international patent applications no. WO 01/23104 and WO 02/078388 the Sound Projector generates the surround-sound environment by emitting beams of sound each representing one of the above channels and reflecting such beams from surfaces such as ceiling and walls back to the listener. The listener perceives the sound beam as if emitted from an acoustic mirror image of a source located at or behind the spot where the last refection took place. This has the advantage that a surround sound system can be created using only a single unit in the room.

Whereas Sound Projector systems that use the reflections of acoustic beams can be installed by trained installers and closely guided users, there remains a desire to facilitate the set-up procedure for less-trained personnel or the average end user.

The problems associated with the setting up of a Sound Projector are not related to certain known methods aiming at partial or total wavefield reconstruction. In the latter methods, it is attempted to record a full wavefield at the listener's position. For reproduction a number of loudspeakers are controlled in a manner that closest approximates the desired wavefield at the desired position. Even though these methods are inherently recording reflections from the various reflectors in a room or concert hall, no attempt is made to infer from these recordings control parameters for a Sound Projector. In essence, the wavefield reconstruction methods are "ignorant" as to the actual room geometry and therefore not applicable to the control problem underlying the present invention.

An important aspect of setting-up a Sound Projector, is determining suitable, or optimum, beam-steering angles for each output-sound-channel (sound-beam), so that after zero, one, or more bounces (reflections off walls, ceilings or objects) the sound beams reach the listener predominantly from the desired directions (typically from in-front, for the centre channel, from either side at the front for the left- and right-front channels, and from either side behind the listener, for the rear-left and right channels). A second important set-up aspect, is arranging for the relative delays in each of the emitted sound beams to be such that they all arrive at the listener time-synchronously, the delays therefore being chosen so as to compensate for the various path lengths between the Sound Projector array and the listener, via their different paths.

Important to performing this set-up task other than by trial and error, is detailed information about the geometry of the listening environment surrounding the Sound Projector and listener, typically a listening room, and in a domestic setting, typically a sitting room. Additional important information are the locations of the listener, and of the Sound Projector, in the environment, and the nature of the reflective surfaces in the surrounding environment, e.g. wall materials, ceiling materials and coverings. Finally, the locations of sound reflective and/or sound obstructive obstacles within the environment need to be known so as to be able to avoid sound-beam paths that intersect such obstacles accidentally.

SUMMARY OF THE INVENTION

The present invention proposes the use of one or a combination of two or more of the following methods to facilitate the installation of a Sound Projector:

A first approach is to use a set-up guide in form of an electronic medium such as CDROM or DVD, or a printed manual, preferably supported by a video display. The user is asked a series of questions, including details of:

The mounting position of the Sound Projector;

The shape and dimensions of the room; and/or

The distance to the listening position from the Sound Projector.

This can either be done through a series of open questions, as in an expert system, or by offering a limited choice of likely answer combinations, together with illustrations to aid clarity.

From this information, a few potential beam directions for each channel can be pre-selected and stored, for example in form of a list. The Sound Projector system can then produce short bursts of band-limited noise, cycling repeatedly through each of these potential directions. For each direction the user is then asked to select a (subjective) best beam direction, for example by activating a button. This step can be repeated iteratively to refine the choice.

Without making use of a microphone, the user may then be asked to select from a menu the type of surface on each wall and on the ceiling. This selection, together with the steering angles as established in the previous step, can be used to derive an approximate equalisation curve. Delay and level matching between channels can be performed using a similar iterative method.

A second approach is to use a microphone that is connected to the Sound Projector, optionally by an input socket. This allows a more automated approach to be taken. With an omni-directional microphone positioned at a point in the room e.g. at the main listening position or in the Sound Projector itself, the impulse response can be measured automatically for a large number of beam angles, and a set of local optima, at which there are clear, loud reflections, can be found. This list can be refined by making further automated measurements with the microphone positioned in other parts of the listening area. Thereafter the best beam angles may be assigned to each channel either by asking the user to specify the direction from which each beam appears to come, or by asking questions about the geometry and deducing the beam paths. Asking the user some preliminary questions before taking measurements will allow the search area, and hence time, to be reduced.

A third approach (which is more automated and thus faster and more user-friendly) includes the step of measuring the impulse responses between a number of single transducers on the panel and a microphone at the listening position. By decomposing the measured impulse responses into individual reflections and using a fuzzy clustering or other suitable algorithm, it is possible to deduce the position and orientation of the key reflective surfaces in the room, including the ceiling and side walls. The position of the microphone (and hence the listening position) relative to the Sound Projector can also be found accurately and automatically.

A fourth approach is to "scan" the room with a beam of sound and use a microphone to detect the reflection that arrives first. The first arriving reflection will have come from the nearest object and so, when the microphone is located at the Sound Projector, the nearest object to the Sound Projector for each beam angle can be deduced. The shape of the room can thereafter be deduced from this "first reflection" data.

Any of the methods described herein can be used in combination, with one method perhaps being used to corroborate the results of a previously used method. In cases of conflict, the Sound Projector can itself decide which results are more accurate or can ask questions of the user, for example by means of a graphical display.

The Sound Projector may be constructed so as to provide a graphical display of its perceived environment so that the user can confirm that the Sound Projector has detected the major reflection surfaces correctly.

These and other aspects of invention will be apparent from the following detailed description of non-limitative examples and by referring to the attached schematic drawings.

DETAILED DESCRIPTION

Figure 8:
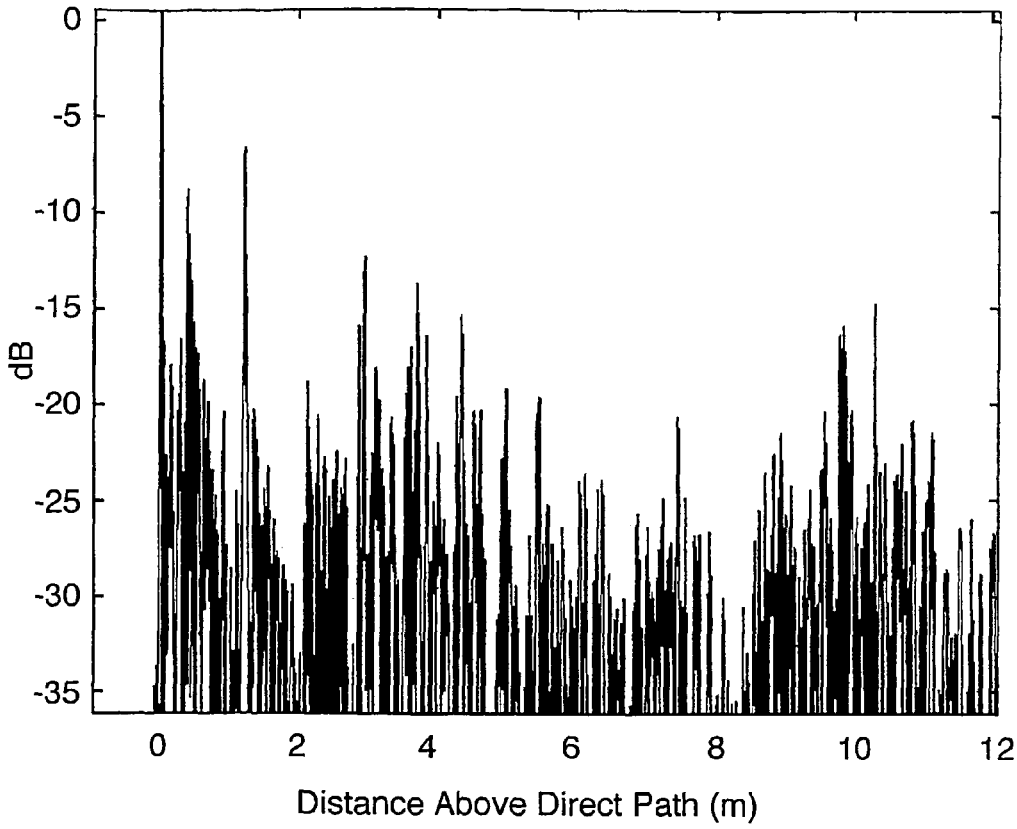
FIG. 8 is a graph showing a registered response at a microphone to a sound signal emitted by a transducer of the Sound Projector system.

The present invention is best illustrated in connection with a digital Sound Projector as described in the co-owned applications no. WO 01/23104 and WO 02/078388. FIG. 21 of WO 01/23104 shows a possible arrangement, although of course the reflectors shown can be provided by the walls and/or ceiling of a room. FIG. 8 of WO 02/078388 shows such a configuration.

Figure 1:
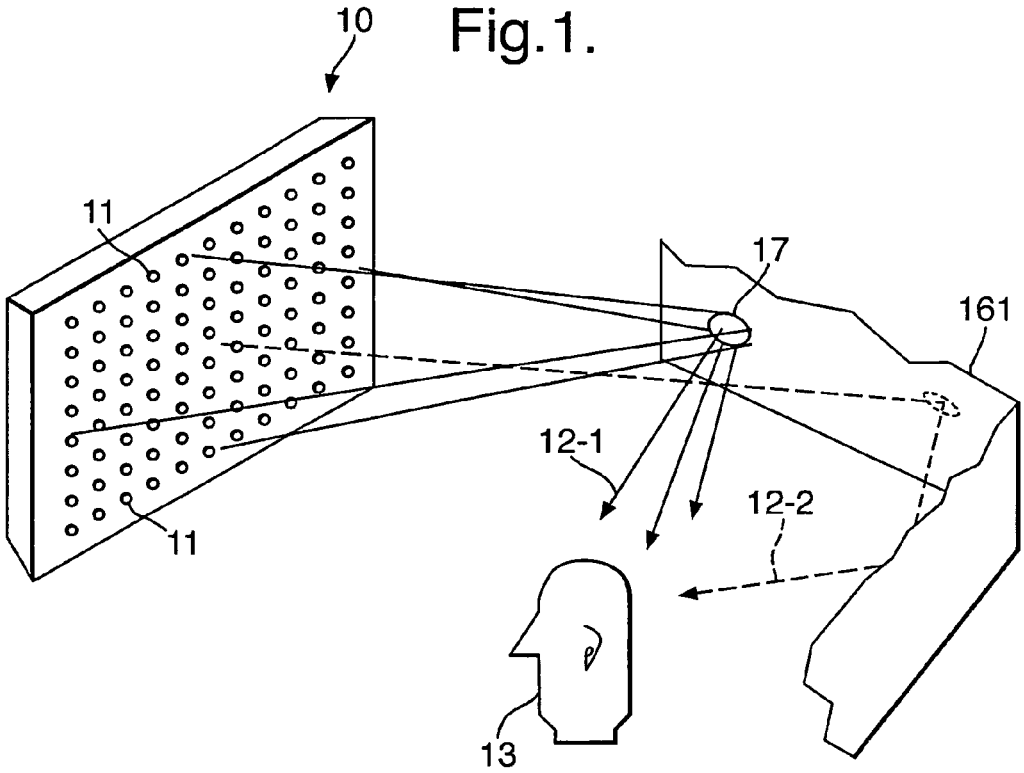
FIG. 1 is a schematic drawing of a typical set-up of a Sound Projector system in accordance with the present invention.

Referring to FIG. 1 of the accompanying drawings, a digital loudspeaker system or Sound Projector 10 includes an array of transducers or loudspeakers 11 that is controlled such that audio input signals are emitted as a beam or beams of sound 12-1, 12-2. The beams of sound 12-1, 12-2 can be directed into—within limits—arbitrary directions within the half-space in front of the array. By making use of carefully chosen reflection paths, a listener 13 will perceive a sound beam emitted by the array as if originating from the location of its last reflection or—more precisely—from an image of the array as reflected by the wall, not unlike a mirror image.

In FIG. 1, two sound beams 12-1 and 12-2 are shown. The first beam 12-1 is directed onto a sidewall 161, which may be part of a room, and reflected in the direction of the listener 13. The listener perceives this beam as originating from an image of the array located at, behind or in front of the reflection spot 17, thus from the right. The second beam 12-2, indicated by dashed lines, undergoes two reflections before reaching the listener 13. However, as the last reflection happens in a rear corner, the listener will perceive the sound as if emitted from a source behind him or her. This arrangement is also shown in FIG. 8 of WO 02/0783808 and the description of that embodiment is referred to and included herein by reference.

Whilst there are many uses to which a Sound Projector could be put, it is particularly advantageous in replacing conventional surround-sound systems employing several separate loudspeakers which are usually placed at different locations around a listening position. The digital Sound Projector, by generating beams for each channel of the surround-sound audio signal and steering those beams into the appropriate directions, creates true surround-sound at the listening position without further loudspeakers or additional wiring.

The components of a Sound Projector system are described in the above referenced published International patent applications no. WO 01/23104 and WO 02/078388 and, hence, reference is made to those applications.

In the following is described the steps leading to the automated identification of reflecting surfaces, such as side-wall 161 in FIG. 1, in a room with a Sound Projector.

For the subsequent method it is assumed that the centre of the front panel of the Sound Projector is centred on the origin of a coordinate system and lies in the yz plane where the positive y axis points to the listeners' right and the positive z axis points upwards; the positive x axis points in the general direction of the listener.

In what follows is described a method of using the Sound Projector, together with a receiving microphone located somewhere within the listening environment, and preferably within the Sound Projector itself, and preferably centred in the Sound Projector array with its most sensitive direction of reception outwards and at right angles to the front surface of the Sound Projector, to measure the room/environment geometry and the relevant locations and surface acoustic properties.

The method may initially be thought of as using the Sound Projector as a SONAR. This is done by forming an accurately steerable beam of sound of narrow beam-width (e.g. ideally between 1 and 10 degrees wide) from the Sound Projector transmission array, using as high an operating frequency as the array structure will allow without significant generation of side-lobes (e.g. around 8 KHz for an array with ~40 mm transducer spacing), and emitting pulses of sound in chosen directions whilst detecting the reflected, refracted and diffracted return sounds with the microphone. The time Tp between the emission of a pulse from the Sound Projector array (the Array) and the reception of any return pulse received by the microphone, (the Mic) gives a good estimate of the path length Lp followed by that particular return signal, where Tp=Lp/c0 (c0 is the speed of sound in air in the environment, typically ~340 m/s).

Similarly, the magnitude Mp of a pulse received by the Mic gives additional information about the propagation path of the sound from the Array to the Mic.

By choosing a range of emission directions for pulses from the Array, determining the received magnitudes and propagation times of the pulses at the Mic, it is possible to determine a great deal of information about the listening environment, and as will be shown, sufficient information to allow automatic set-up of the Sound Projector in most environments.

Several practical difficulties make the procedure just described complicated. The first is that surfaces which are smooth on a size scale significantly less than a wavelength of sound, will produce dominantly specular reflections, and not diffuse reflections. Thus a sound beam hitting a wall will tend to bounce off the wall as if the wall was an acoustic mirror, and in general the reflected beam from the wall will not return directly to the source of the beam, unless the angle of incidence is approximately 90 degrees (in both planes). Thus most parts of a room might seem to be not directly detectable by a sonar system as described, with only multiply reflected beams (off several walls, and/or the floor, and/or ceiling and/or other objects within the room) returning to the Mic for detection.

A second difficulty is that the ambient noise level in any real environment will not be zero—there will be background acoustic noise, and in general this will interfere with the detection of reflections of sound-beams from the Array.

A third difficulty is that sound beams from the Array will be attenuated, the more the further they travel prior to reception by the Mic. Given the background noise level, this will reduce the signal to noise ratio (SNR).

Finally, the Array will not produce perfect uni-directional beams of sound—there will be some diffuse and sidelobe emissions even at lower frequencies, and in a normally reflective typical listening room environment, these spurious (non-main-beam) emissions will find multiple parallel paths back to the Mic, and they also interfere with detection of the target directed beam.

We now describe several solutions to the above problems which may be used singly or in combination to alleviate these problems. In what follows, by "pulse" we mean a short burst of sound of typically sinusoidal wave form, typically of several to many cycles long.

The received signal at the Mic after emission of one pulse from the Array, will not in general be simply an attenuated, delayed replica of the emitted signal. Instead the received Mic signal will be a superposition of multiple delayed, attenuated and variously spectrally modified copies of the transmitted pulse, because of multipath reflections of the transmitted pulse from the many surfaces in the room environment. In general, each one of these multipath reflections that intersects the location of the Mic will have a unique delay (transit time from the Array) due to its particular route which might involve very many reflections, a unique amplitude due to the various absorbers encountered on its journey to the Mic and due to the beam spread and due to the amount the Mic is off-axis of the centre of the beam via that (reflected) route, and a unique spectral filtering or shaping for similar reasons. The received signal is therefore very complex and difficult to interpret in its entirety.

In a conventional SONAR system a directional transmitter antenna is used to emit a pulse and a directional receive antenna (often the same antenna as used for transmissions) is used to collect energy received principally from the same direction as the transmitted beam. In the present invention the receiving antenna can be a simple microphone, nominally omnidirectional (easily achieved by making it physically small compared to the wavelengths of interest).

Only one (or a few) dedicated microphone(s) may be used as a receiver, which microphone(s) is (are) not part of the Array although it (they) may preferably be physically co-located with the Array.

The method described here relies on the surprising fact that no acoustic reflection is totally specular—there is always some diffuse reflection too. Consequently, if a beam of sound is directed at a flat surface not at right angles to the sound source, some sound will still be reflected back to the source, regardless of the angle of incidence. However, the return signal will diminish rapidly with angle away from normal incidence, if the reflecting surface is nominally "flat", which in practice means it has surface deviations from planarity small compared to the wavelength of sound directed at it. For example, at 8 KHz, most surfaces in normal domestic rooms are nominally "flat" as the wavelength in air is then about 42 mm, so wood, plaster, painted surfaces, most fabrics and glass all are dominantly specular reflectors at this frequency. Such surfaces have roughness typically on the scale of 1 mm and so appear approximately specular up to frequencies as high as 42×8 KHz~330 KHz.

As a consequence, the direct return signals from most surfaces of a room will be only a very small fraction of the incident sound energy. However, if these are detectable, then determining the room geometry from reflections is greatly simplified, for the following reason. For a tightly directed beam (say of a few degrees beamwidth) the earliest reflection at the Mic will in general be from the first point of contact of the transmitted beam with the room surfaces. Even though this return may have small amplitude, it can be fairly certainly assumed that its time of arrival at the Mic is a good indicator of the distance to the surface in the direction of the transmitted beam, even though much stronger (multi-path) reflections may follow some time later. So detection of first reflections allows the Sound Projector to ignore the complicated paths of multi-path reflections and to simply build up a map of how far the room extends in each direction, in essence by raster scanning the beam about the room and detecting the time of first return at each angular position.

Figure 2:
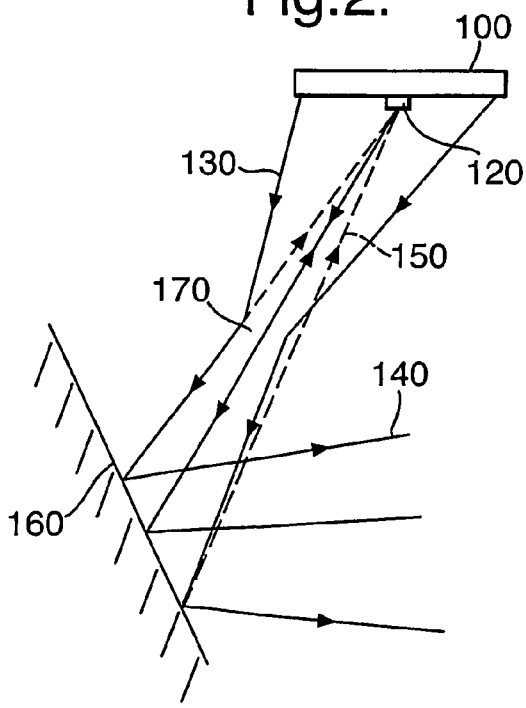
FIG. 2 shows a Sound Projector having a microphone mounted in its front face and shows diffuse and specular reflections from a wall, the diffuse reflections returning to the microphone.

FIG. 2 of the accompanying drawings shows a Sound Projector 100 having a microphone 120 at the front centre position. Although the microphone 120 is shown protruding in FIG. 2, it can in practice be flush with the front panel of the Sound Projector 100, in the same plane as the array of transducers or even behind the array plane. The Sound Projector is shown directing a beam 130 to the left (as viewed in FIG. 2) towards a wall 160. The beam 130 is shown focused so as to have a focal point 170 in front of the wall meaning that it converges and then diverges as shown in FIG. 2. As the beam interacts with the wall it produces a specular reflection 140 having an angle of reflection equal to the angle of incidence. The specular reflection is thus similar to an optical reflection on a mirror. At the same time, a weaker diffuse reflection is produced and some of this diffuse reflected sound, shown as 150, is picked up by the microphone 120.

Figure 3:
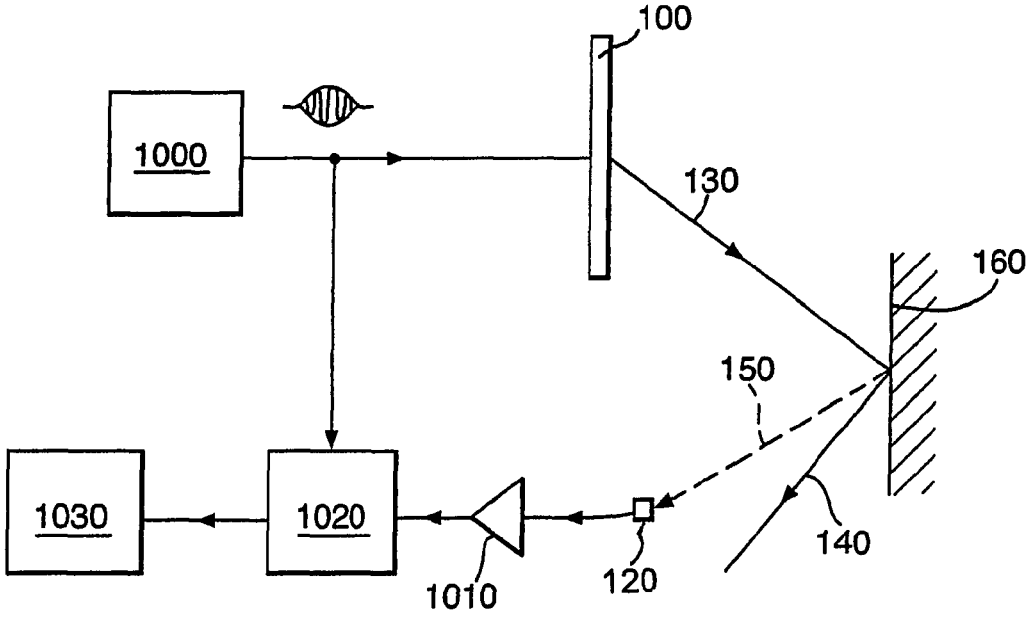
FIG. 3 is a block diagram showing some of the components needed to deduce the time of first diffuse reflection so as to detect surfaces in the listening room.

FIG. 3 shows a schematic diagram of some of the components used in the set up procedure. A pulse generator 1000 generates a pulse (short wave-train) of reasonably high frequency, for example 8 khz. In this example the pulse has an envelope so that its amplitude increases and then decreases smoothly over its duration. This pulse is fed to the digital Sound Projector as an input and is output by the transducers of the Sound Projector in the form of directed beam 130. The beam 130 undergoes a diffuse reflection at wall 160, part of which becomes diffuse reflection 150 which is picked up by microphone 120. Note that FIG. 3 shows the part diffuse reflection 150 as being in a different direction to incoming beam 130 for clarity only. In practice, the relevant part of the diffuse reflection 150 will be in the direction of the microphone 120, and when the microphone is located in the front panel of the DSP 100, as shown in FIG. 2, the reflection 150 will be in the same (opposite) direction as the transmitted beam 130. The signal from microphone 120 is fed to microphone pre-amplifier 1010 and thereon to a signal processor 1020. The signal processor 1020 also receives the original pulse from the pulse generator 1000. With this information, the signal processor can determine the time that has elapsed between emitting the pulse and receiving the first diffuse reflection at the microphone 120. The signal processor 1020 can also determine the amplitude of the received reflection and compare it to the transmitted pulse. As the beam 130 is scanned across the wall 160, the changes in time of receiving the first reflection and amplitude can be used to calculate the shape of wall 160. The wall shapes are calculated in room data output block 1030 shown in FIG. 3.

Figure 4:
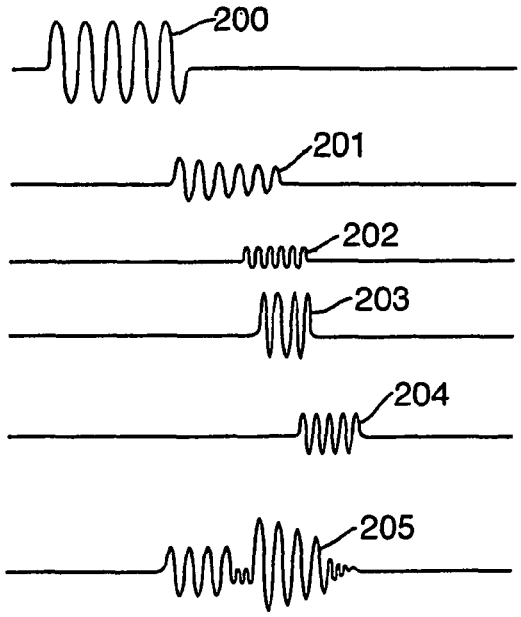
FIG. 4 is a series of graphs showing a transmitted pulse and various reflected pulses which are superposed to form the microphone output.

FIG. 4 illustrates how the signal received at the microphone is made up of a number of pulses that have traveled different distances due to different path lengths. Pulse 200 shown in FIG. 4 is the transmitted pulse. Pulses 201, 202, 203 and 204 are four separate reflections (of potentially very many) of transmitted pulse 200 which have been reflected from different objects/surfaces at various distances from the array. As such, the pulses 201 to 204 arrive at the microphone at different times. The pulses also have differing amplitudes due to the different incidence angles and surface properties of the surfaces from which they reflect. Signal 205 is a composite signal received at the microphone which comprises the result of reflections 201 to 204 adding/subtracting at the location of the microphone. One of the problems overcome by the present invention is how to interpret signal 205 received at the microphone so as to obtain useful information about the room geometry.

Inevitably there will be obstacles in the room (such as furniture), and apertures (e.g. open doors and windows) and these will give typically strong returns (because furniture is quite "structured" and has many directions of reflecting surface), and weak or absent returns, respectively. In determining the room geometry from the first-returns data, provision needs to be made for recognising such "clutter" which are not part of the room proper. Some methods of reliably identifying surfaces and separating this clutter from room reflections proper are described below.

Range-Gating:

the receiver is turned off (the "gate" is closed) until some time after completion of the transmission pulse from the Array to avoid saturation and overload of the detector by the high-level emissions from the Array;

the receiver is then turned on (the "gate" is opened) for a further period (the detection period);

the receiver is then turned off again to block subsequent and perhaps much stronger returns;

With range gating the receiver is blinded except for the on-period, but it is also shielded from spurious signals outside this time; as time relates to distance via the speed of sound, the receiver is essentially on for signals from a selected range of distances from the Array, thus multipath reflections which travel long distances are excluded.

Beam-Focus:

Where the Array is capable of focussing a sound beam at a specific distance from the Array, then the SNR from a weak first reflection can be considerably improved by adjusting the beam focus such that it coincides with the distance of the first detected reflector in the beam. This increases the energy density at the reflector and thus increases the amplitude of the scattered/diffuse return energy. In contrast, any interfering/spurious returns from outside the main beam will not in general be increased by such beam focussing, thus increasing the discrimination of the system to genuine first returns. Thus, a beam not focussed at the surface may be used to detect a surface (as shown in FIG. 2) and a focused beam can then be used to confirm the detection.

Phase-Coherent Detection:

If the SNR of a first return signal is very low, then a phase coherent detector tuned to be sensitive primarily only to return energy in phase with a signal from the specific distance of the desired first-return target will reject a significant portion of background noise which will not be correlated with the Array signal transmitted. In essence, if a weak return is detected at time Tf corresponding to a target first-reflection at distance Df, then it can be computed what phase the transmitted signal would have if delayed by that time (Tf). Multiplying the return signal with a similarly phase-shifted version of the transmitted signal will then actively select real return signals from that range and reject signals and noise from other ranges.

Chirp:

There will be some maximum transmission amplitude that the Array is operable at in set-up mode, limited either by its technical capability (e.g. power rating) or by acceptable noise levels during set-up operations. In any case, there is some practical limit to transmitted signal level, which naturally limits weak reflection detection because of noise. The total energy transmitted in a transmission pulse is proportional to the product of the pulse amplitude squared and the pulse length. Once the amplitude is maximised, the only way to increase the energy is to lengthen the pulse. However, the range resolution of the described technique is inversely proportional to pulse length so arbitrary pulse lengthening (to increase received SNR) is not acceptable. If instead of emitting a constant frequency tone during the transmitted pulse from the Array, a chirp signal is used, typically falling in frequency during the pulse, and if a matched filter is used at the receiver (e.g. a dispersive filter which delays the higher frequencies longer) then the receiver can effectively compress in time a long transmitted pulse, concentrating the signal energy into a shorter pulse but having no effect on the (uncorrelated) noise energy, thus improving the SNR whilst achieving range-resolution proportional to the compressed pulse length, rather than the transmitted pulse length.

One, some or a combination of all of the above signal processing strategies can be used by the Sound Projector to derive reliable first-return diffuse reflection signals from the first collision of the transmitted beam from the Array with the surrounding room environment. The return signal information can then be used to derive the geometry of the room environment. A series of reflection-conditions and strategies for analyzing the data will now be described.

Smooth Planar Continuous Surface:

A smooth continuous surface in the room environment, such as a flat will or ceiling probed by the beam from the Array (the Beam), and which is considerably bigger than the beam dimensions where it impacts the surface, will give a certain first-return signal amplitude (a Return) dependent on:

- the nature of the surface (assumed smooth);
- the minimum angle (the Impact Angle) between the plane of the surface and the axis of the beam (the Beam Axis);
- the distance (the Target Distance) of the centre of the beam impact point (the Beam Centre) from the Array centre;
- (and any intervening clutter such as small obstacles of furniture etc which may scatter some of the beam both in its outward path from the Array and return path to the Mic, but which is not big enough to obscure the surface from the Mic and Array).

The delay between transmission of pulse from the Array and reception of Return by the Mic (the Delay) will be directly proportional to the Target Distance, when the MIC is located in the front panel of the Array.

The Impact Angle is a simple function of the relative orientations of the Array, the surface, and the beam steering angle (the Beam Angle, which is a composite of an azimuth angle and an altitude angle).

Thus, if the Beam is steered smoothly across any such position on this surface, the Return will also vary smoothly in amplitude, and the Delay will vary smoothly too. Thus a characteristic signature of a large, smooth, continuous surface in the direction of the beam is that the Return and Delay vary smoothly with small changes in Beam Angle. The distance to the surface (the Distance) at any given Beam Angle a is given directly by Da=c×Delay, where c is the speed of sound, a known constant to a good approximation (in a practical implementation, where high accuracy is required, the value of c used may be corrected for ambient temperature and or ambient pressure using the well known equations and readings from an internal thermometer and/or barometric pressure sensor).

In a preferred practical method large, smooth surfaces in the environment are located by steering the Beam to likely places to find such surfaces (e.g. approximately straight ahead of the Array, roughly 45 deg to either side of the array, and roughly 45 deg above and below the horizontal axis of the array). At each such location, a Return is sought, and if found the Beam may be focussed at the distance corresponding to the Delay there, to improve SNR as previously described. Thereafter, whilst continuously adjusting focus distance to correspond to the measured Delay, the Beam is scanned smoothly across such locations and the Delay and Return variation with Beam Angle recorded. If these variations are smooth then there is a strong likelihood that large smooth surfaces are present in these locations.

The angle Ps of such a large smooth surface relative to the plane of the Array may be estimated as follows. The distances D1 and D2, and Beam Angles A1 and A2 in the vertical plane (i.e. Beam Angles A1 and A2 have zero horizontal difference), for 2 well-separated positions within the detected region of the surface are measured directly from the Array settings and return signals. The geometry then gives a value for the vertical component angle Pvs of Ps as $$Pvs=\tan^{-1}((D2\ \mathrm{Sin}\ A2-D1\ \mathrm{Sin}\ A1)/(D1\ \mathrm{Cos}\ A1-D2\ \mathrm{Cos}\ A2))$$

If the process is repeated by scanning the beam to two locations A3 and A4 with the same vertical beam angle, giving Return distances of D3 and D4, then the horizontal component angle Phs of Ps is given by $$Phs=\tan^{-1}((D4\ \mathrm{Sin}\ A4-D3\ \mathrm{Sin}\ A3)/(D3\ \mathrm{Cos}\ A3-D4\ \mathrm{Cos}\ A4))$$

In practice any such measurements will be subject to noise and the reliability of the results (Pvs & Phs) may be increased by averaging over a large number of pairs of locations suitably chosen as described, for each surface located.

Assuming that the above processes detect n surfaces, the surface angles $Ps_i$, i=1 to n, and distances $Ds_i$, i=1 to n (computed from an average of all the distance measurements gleaned from the Ps measurements) are determined for each of the n detected surfaces, then their locations in space and their intersections are readily calculated. In a conventional cuboid domestic listening room one might expect to find n=6 (or n=5 if the Array is placed against and parallel to one of the walls) and most of the walls to be approximately vertical, and the floor and ceiling to be approximately horizontal, but it should be clear from the description given that the method in no way relies on any assumptions about how many surfaces there are, where they are, or what their relative angles are.

Smooth Non-Planar Continuous Surface:

Where the surface being targeted by the Beam is non-planar (but still smooth—i.e. corners and surface junctions are excluded under this heading) but moderately curved then the procedure described above for planar-surfaces will suffice for characterising it as a smooth surface. To distinguish it from a plane surface it is only necessary to examine the variation of D (distance measure) with Beam Angle. For positively curved surfaces (i.e. the centre of the curvature lies on the opposite side of the surface to the Array), there will be a systematic increase of distance to the surface at positions around a reference position, relative to the distances expected for a plane surface of similar average angle to the beam. The method described for measuring the angle of a plane surface (which involved averaging a number of distance and angle measurements and their implied (plane-surface) angles) will instead give an average surface angle for the curved surface, averaged over the area probed by the Beam. However, instead of having a random error distribution about the average distance, the distance measurements will have a systematic distribution about the average the difference increasing or decreasing with angular separation for convex and concave surfaces respectively, as well as a random error distribution. This systematic difference is also calculable and an estimate of the curvature derived from this. By performing an analysis of distance distributions in both the vertical and horizontal planes, two orthogonal curvature estimates may be derived to characterise the surface's curvature.

Junction of Two Smooth Continuous Surfaces:

Where two surfaces join and/or intersect at an angle (i.e as happens for example in the corner of a room between two walls, or at the junction of the floor or ceiling and a wall) then the smooth variation of Distance and Return with Beam Angle becomes piecewise continuous instead. The Return strength will often be significantly different from the two surfaces due to their different angles relative to the Beam Axis, the surface most orthogonal to the Axis giving the stronger Return, all else being equal.

The Distance measurement will be approximately continuous across the surface join but in general will have a different gradient with Beam Angle either side of the join. The nature of the gradients either side of the join will allow discrimination between concave surface junctions (most common inside cuboidal rooms) and convex surface junctions (where for example a passage or alcove connects to the room). As with convex and concave surfaces, the Distance to points on the surfaces either side of the junction will be longer for a convex junction and shorter for a concave junction.

Where such a junction signature is detected, a successful nearby search for smooth continuous surfaces either side of the discontinuity will give added certainty about the detection of a surface junction. By measuring the surface angles of the two joined surfaces, and their distances at the join, it is straightforward to calculate the trajectory in space of the junction. This can then be tracked by the Beam and a small lateral sweep as the Beam slowly tracks along the junction will either give a confirmatory Return strength difference from either side of the junction together with a relatively smooth Distance estimate agreeing with the junction trajectory computation, or it will not, in which latter case the data will need to be re-analysed in case the detection of a junction is false, due to inadequate SNR, or is a more complex junction as described below.

Figure 5:
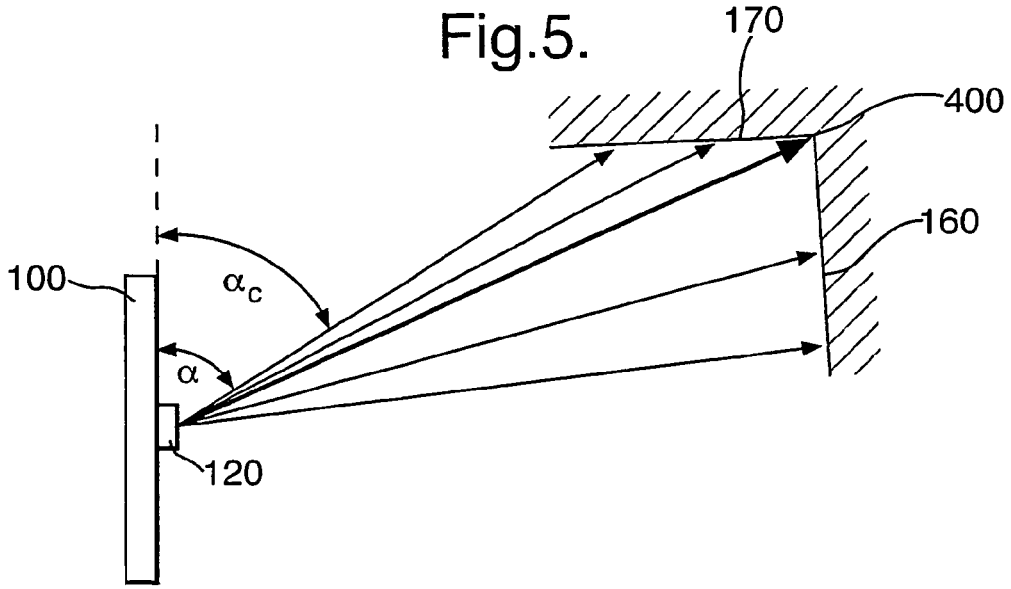
FIG. 5 shows a sound beam scanning a corner in a room.
Figure 6:
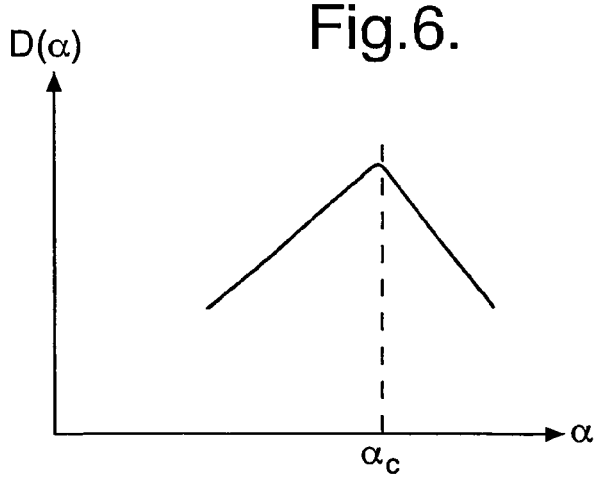
FIG. 6 shows the calculated distance of the solid surfaces of FIG. 5 from the Sound Projector according to the time of first reflection detected by the microphone.

This method is illustrated in FIG. 5. Here is shown a Sound Projector 100 sending a beam towards a corner 400 between a first wall 170 and a second wall 160. The angle relative to the plane of the Array of a line joining the corner to the microphone is defined as $\alpha_0$. As the beam is scanned along the wall 170 towards the corner 400 and thereafter along the wall 160 (i.e. the angle of beam a is slowly increased in the horizontal direction), the time of first received reflection and amplitude of first received reflection direction will change. It will be appreciated that as the beam scans along the first wall 170 towards the corner 400, the time of first reflection increases and then as the beam scans along the wall 160 the time of first reflection decreases. The Sound Projector can correlate the reflection time to the distance from the microphone of the surfaces 170, 160 and FIG. 6 shows how these distances $D(\alpha)$ change as the beam scans from one wall across the corner to the other wall. As can be seen, the computed Distance $D(\alpha)$ is continuous but has a discontinuous gradient at $\alpha_0$.

Figure 7:
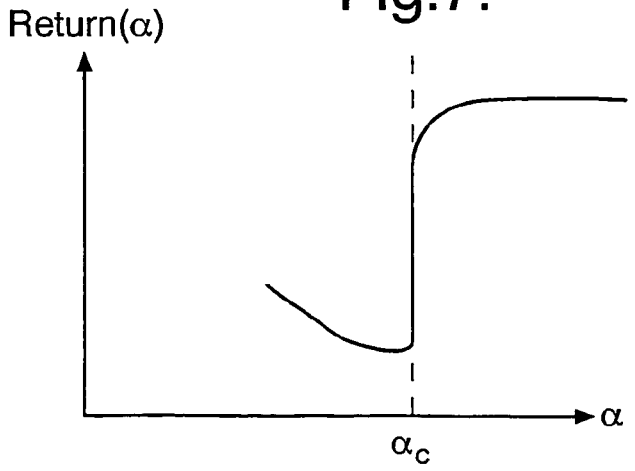
FIG. 7 shows the amplitude of signals received by the microphone as the beam scans the corner shown in FIG. 5.

It will also be understood that reflections from the wall 170 will be much weaker than reflections from the wall 160 due to the fact that the beam meets the wall 170 at smaller angles than the angles at which it meets the wall 160. FIG. 7 shows a graph of reflected signal strength Return($\alpha$) against $\alpha$ and it can be seen that this is discontinuous at $\alpha_0$ with a sudden jump in signal strength occurring as the beam stops scanning the wall 170 and starts scanning the wall 160. In practice, such sharp features as displayed in FIG. 6 and FIG. 7 will be smoothed somewhat due to the finite bandwidth of the beam.

The discontinuities and gradient changes in the graphs of FIGS. 6 and 7 can be detected by the controller electronics of the Sound Projector so as to determine the angle $\alpha_0$ at which a corner appears.

This process for detecting and checking the locations of junctions works equally well whether the bounding surfaces are plane or moderately curved.

Once the two or three major vertical corners and the three or four major horizontal junctions between the walls and ceiling visible from the location of the Array in a conventional cuboidal listening room, have been detected by this method, the room geometry can be reasonably accurately determined. For non-cuboidal rooms further measures may be necessary. If the user has already inputted that the room is cuboidal, no further scanning is necessary.

Junctions Between Three or More Smooth Surfaces:

Where a junction has been detected as described above but the junction tracking process fails to match the computed trajectory, then it is likely that this is a trihedral junction (e.g. between two walls and a ceiling) or another more complex junction. These may be detected by tracking the Beam around the supposed junction location, and looking for additional junctions non-co-linear with the first found. These individual surface junctions can be detected as described above for two-surface junctions, sufficiently far away from the location of the complex junction that only two surfaces are probed by the beam. Once these additional 2-surface junctions have been found, their common intersection location may be computed and compared to the complex junction location detected as confirmatory evidence.

Discontinuity in a Surface:

Where a reflecting surface abruptly ends (e.g. as at an open door or window), there will be an associated discontinuity in both Return strength, and Delay or equivalently, Distance estimate. Where the Beam leaves the surface and probes beyond its end the Return will often be undetectable in which case the Delay will not be measurable either. Such a discontinuity is a reliable signature of a "hole" in the room surface. However, an object in the room that has particularly high absorbency of the acoustic energy in the Beam may also give a similar signature. Either way, such an area of the room is not suitable for Beam bouncing in surround-sound applications and so in either case should simply be classified as such (i.e. as an "acoustic hole"), for later use in the set-up process.

Use of a combination of the above methods together with a range of simple search strategies for probing the room allows detection and measurement of the major surfaces and geometric features such as holes, corners, alcoves and pillars (essentially a negative alcove) of a listening room. Once these boundary locations are derived relative to the Array location, it is possible to calculate beam trajectories from the Array by the standard methods of ray-tracing, used for example in optics.

Once the room geometry is known, the direction of the various beams for the surround sound channels that are to be used can be determined. This can be done by the user specifying the optimum listening position (for example using a graphical display and a cursor) or by the user placing a microphone at the listening position and the position of the microphone being detected (for example using the method described in WO 01/23104). The Sound Projector can then calculate the beam directions required to ensure that the surround sound channels reach the optimum listening position from the correct direction. Then, during use of the device, the output signals to each transducer are delayed by the appropriate amounts so as to ensure that the beams exit from the array in the selected directions.

In a variant of the invention, the Array is also used either in its entirety or in parts thereof, as a large phased-array receiving antenna, so that selectivity in direction can be achieved at reception time too. In practice the cost, complexity and signal-to-noise complications arising from using an array of high-power-driven acoustic transmitting transducers as low-noise sensitive receivers (in the same equipment even if not actually simultaneously) make this option useful only for very special purposes where cost & complexity is a secondary issue. Nonetheless, it can be done, by using very low resistance analogue switches to connect the transducers to the output power amplifiers during the transmission pulse phase of the process, and turning off these analogue switches during the receive phase, and instead in the receive phase connecting the transducers with low-noise analogue switches to sensitive receive-pre-amplifiers and thence to ADCs to generate digital receive signals that are then beam-processed in the conventional phased-array (receive) antenna manner, as is well known in the art.

Another method for setting up the Sound Projector will now be described, this method involving the placement of a microphone at the listening position and analysis of the microphone output as sound pulses are emitted from one or more of the transducers in the array. In this method, more of the signal (rather than just the first reflection of the pulse registered by the microphone) is analysed so as to estimate the planes of reflection in the room. A cluster analysis method is preferably used.

The microphone (at the listening point usually) is modeled by a point in space and is assumed to be omnidirectional. Under the assumption that the reflective surfaces are planar, the system can be thought of as an array of microphone "images" in space, with each image representing a different sound path from the transducer array to the microphone. The speed of sound c is assumed to be known, i.e. constant, throughout, so distances and travel-times are interchangeable.

Given a microphone located at (xmic; ymic; zmic) and a transducer located at (0; yi; zi), the path distance to the microphone is $$di=(xmic\hat{}2+(ymic-yi)\hat{}2+(zmic-zi)\hat{}2)\hat{}(1/2), \quad [1]$$

which can be rewritten as the equation of a two-sheeted hyperboloid in (di; yi; zi) space as follows:

$$di\hat{}2-(ymic-yi)\hat{}2-(zmic-zi)\hat{}2=xmic\hat{}2 \quad [2]$$

The "^" notation indicates an exponent.

To measure an impulse response, a single transducer is driven with a known signal, for example five repeats of a maximum length sequence of 2^18−1 bits. At a sampling rate of 48 kHz this sequence lasts 5.46 seconds.

A recording is taken using the omnidirectional microphone at the listening position. The recording is then filtered by convolving it with the time-reversed original sequence and the correlation is calculated by adding the absolute values of the convolved signal at each repeat of the sequence, to improve the signal-to-noise ratio.

The above impulse measurement is performed for several different transducers in the array of the Sound Projector. Using multiple sufficiently uncorrelated sequences simultaneously can shorten the time for these measurements. With such sequences it is possible to measure the impulse response from more than one transducer simultaneously.

In order to test the following algorithms, a listening room was set up with a Mk 5a DSP substantially as described in WO 02/078388 and an omnidirectional microphone on a coffee table at roughly (4.0; 0.0; 0.6), and six repeats of a maximum length sequence (MLS) of 2^18−1 bits was sent at 48 kHz to individual transducers by selecting them from the on-screen display. The Array comprises a 16×16 grid of 256 transducers numbered 0 to 255 going from left-to-right, top-to-bottom as you look at the Array from the front. Thirteen transducers of the 256 transducer array were used, forming a roughly evenly spaced grid across the surface of the DSP including transducers at "extreme" positions, such as the centre or the edges. The microphone response was recorded as 48 kHz WAV-format files for analysis.

The time-reversed original MLS (Maximum Length Sequence) was convolved with the response from each transducer in turn and the resulting impulse response normalized by finding the first major peak (corresponding to the direct path) and shifting the time origin so this peak was at t=0, then scaling the data so that the maximum impulse had height 1. The time shift alleviates the need to accurately synchronize the signals.

A segment of the impulse response of transducer 0 (in the top-left corner of the array) is shown in FIG. 8. The graph shows the relative strength of the reflected signal versus the travel path length as calculated from the arrival time. Several peaks (above −20 dB) are identifiable in the graph, for example the peaks at 0.4 m, 1.2 m, 3.0 m, 3.7 m and 4.4 m.

Figure 9:
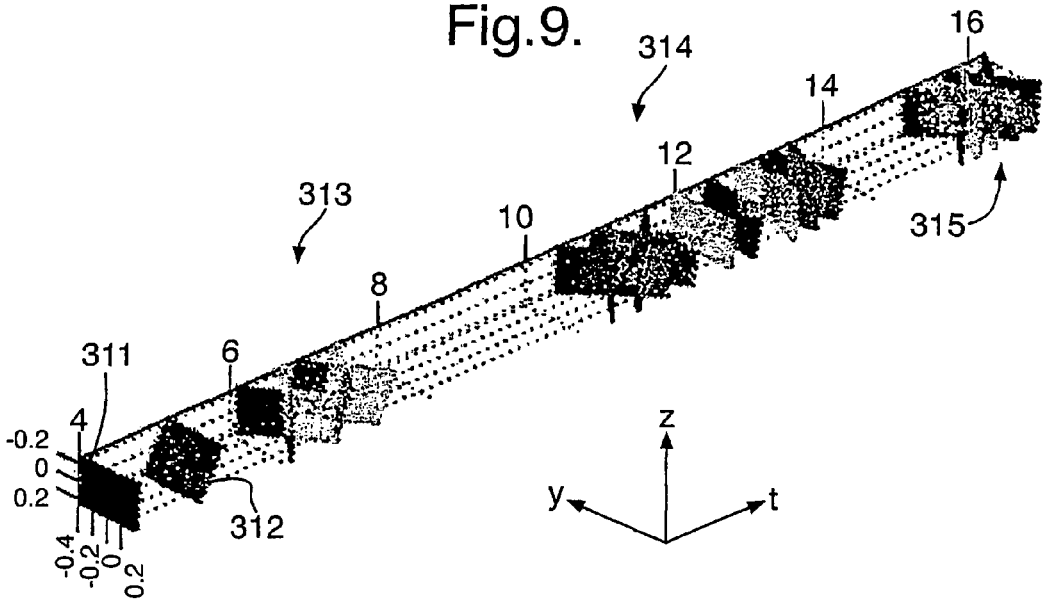
FIG. 9 is a modeled impulse response for an idealized room.

Before attempting to associate these peaks with reflectors in a room, a model of the signals expected from a perfectly reflecting room is illustrated in FIG. 9.

FIG. 9 is a graph of the 'perfect' impulse response of a room with walls 2.5 m either side of the Sound Projector, a rear wall 8 m in front of it and a ceiling 1.5 m above it, as heard from a point at (4; 0; 0). The axis t represents time and the axes z and y are spatial axes related to the transducer being used. As the signal is reflected from reflecting surfaces the microphone measures a reflection image of that surface in accordance with the path or delay values from equations [1] or [2]. The direct path and reflections from the ceiling respectively correspond to the first two surface images 311, 312, and the next four intermingled arrivals 313 correspond to the reflections from the sidewalls with and without the ceiling, respectively. Other later arrivals 314, 315 represent reflections from the rear wall or multiple reflections. Using the model of FIG. 9, a plausible interpretation of some of the major peaks of FIG. 8 can be given. Table 1 below lists these interpretations.

TABLE 1

| Distance (m) | Likely source |
|---|---|
| 0 | Direct path from transducer to microphone |
| 0.4 | Reflection from coffee table |
| 1.2 | Reflection from ceiling |
| 3.0, 3.7, 4.4 | Reflection from side walls with/without ceiling. |

The algorithms detailed below are concerned with performing this analysis automatically without prior knowledge of the shape of the room or its contents and thus identifying suitable reflecting surfaces and the orientation with respect to the Sound Projector.

After or while measuring the impulse response from several transducers located at different positions spread across the array the data is searched for arrivals that indicate the presence of reflecting surfaces in the listening room.

In the present example the search method is making use of an algorithm that identifies clusters in the data.

In order to improve the performance of the clustering algorithm, it is useful to perform a preclustering step to remove a large quantity of noise from the data and to remove large spaces devoid of clusters. In the case of FIG. 8, preclusters were selected within the following ranges of minimum level in dB and minimum and maximum distance in meters: precluster 1 (−15, 0, 2); precluster 2 (−18, 2.8, 4.5), and precluster 3 (−23, 9, 11).

Once the data has been separated roughly into a noise cluster and a number of clusters which potentially contain impulses from reflections, a modified version of the fuzzy c-varieties (FCV) algorithm described for example in James C. Bezdek, "Pattern Recognition with Fuzzy Objective Function Algorithms", Plenum Press, New York 1981, is applied to the data to seek out planes of strong correlation. The 'fuzziness' of the FCV algorithm comes from a notion of fuzzy sets: the ith data point is a member of the kth fuzzy cluster to some degree, called the degree of membership and denoted U(ik). The matrix U is known as the membership matrix.

The FCV algorithm relies on the notion of a cluster "prototype", a description of the position and shape of each cluster. It proceeds by iteratively designing prototypes for the clusters using the membership matrix as a measure of the importance of each point in the cluster, then by reassigning membership values based on some measure of the distance of each point from the cluster prototype.

The algorithm is modified to be robust against noise by including a "noise" cluster which is a constant distance from each point. Points which are not otherwise assigned to "true" clusters are classified as noise and do not affect the final clusters. This modified algorithm is referred to as "robust FCV" or RFCV.

It is common when running the algorithm that it will converge to a local optimum which is not optimal enough, in the sense that it does not correspond to a cluster representing a reflection. This issue is corrected by waiting for the rate of convergence to drop low enough that further large changes become unlikely (typically a change-per-iteration of 10^−3) and to check the validity of the cluster. If it is deemed to be invalid then the next step involves a jump to a randomly chosen point elsewhere in the search space.

The original FCV algorithm relies on fixing the number of clusters before running the algorithm. A fortunate side-effect of the robustness of the modified algorithm is that if too few clusters are selected it will normally be successful in finding as many clusters as were requested. Thus a good method for using this algorithm is to search for a single cluster, then a second cluster, and continue increasing the number of clusters, preserving the membership matrix at each step, until no more clusters can be found.

Another parameter to be chosen in the algorithm is the fuzziness degree, m, which is a number in the range between 1 and infinity. The value m=2 is commonly used as a balance between hard clustering (m→1) and overfuzziness (m→infinity) and has been successfully used in this example.

The number of clusters c is initially unknown, but it must be specified when running the RFCV algorithm. One way of discovering the correct value of c is to successfully try the algorithm for each c up to a reasonable cmax, starting at c=1. In its non-robust form and with noise-free data the algorithm will successfully pick out c clusters when c clusters are present. If there are more or fewer than c clusters present, at least one of the clusters that the algorithm finds will fail to pass tests of validity which gives a clear indication as to which value of c is correct.

The robust version performs better when there are more than c clusters present: it finds c clusters and classifies any others as noise. This improvement in performance comes at the expense of having less indication which value of c is truly correct. This problem can be resolved by using an incremental approach, such as follows:

1. Run the algorithm with c=1 and without specifying the initial membership matrix U0 of the algorithm so that the initial prototype is randomly generated.
2. Repeat the following steps until the algorithm returns fewer than c prototypes:
2.1 Increment c and set U0 to be the final membership matrix of the preceding step, including the membership values into the "noise" cluster.
2.2 Rerun the algorithm.

This method has a number of advantages. Firstly, the algorithm never runs with fewer than c−1 clusters, so the wait for extraneous prototypes to be deleted is minimized. Secondly, the starting point of each run is better than a randomly chosen one, since c−1 of the clusters have been found and the remaining data belongs to the remaining prototype(s).

Figure 10A:
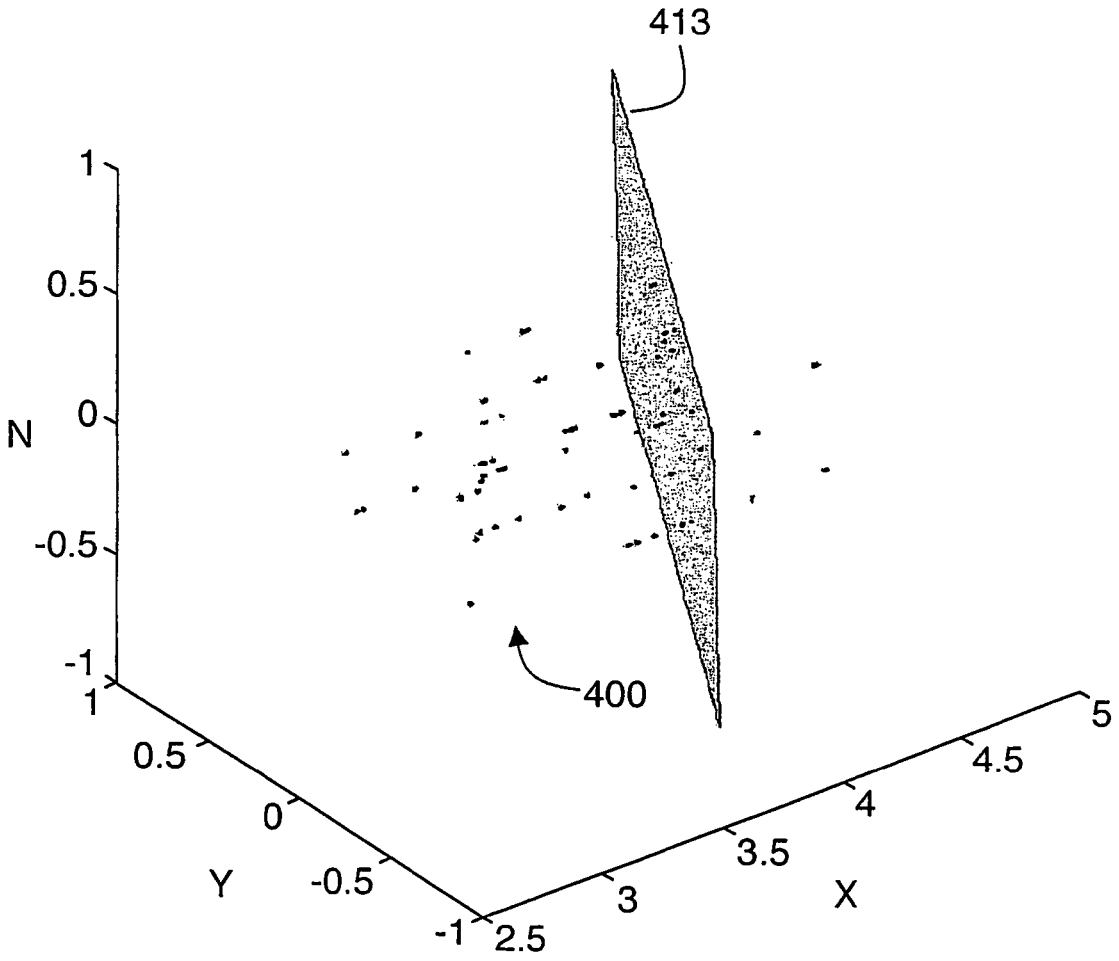
FIGS. 10A to 10E show results of cluster analysis performed on registered responses to signals emitted from different transducers of the Sound Projector system.
Figure 10B:
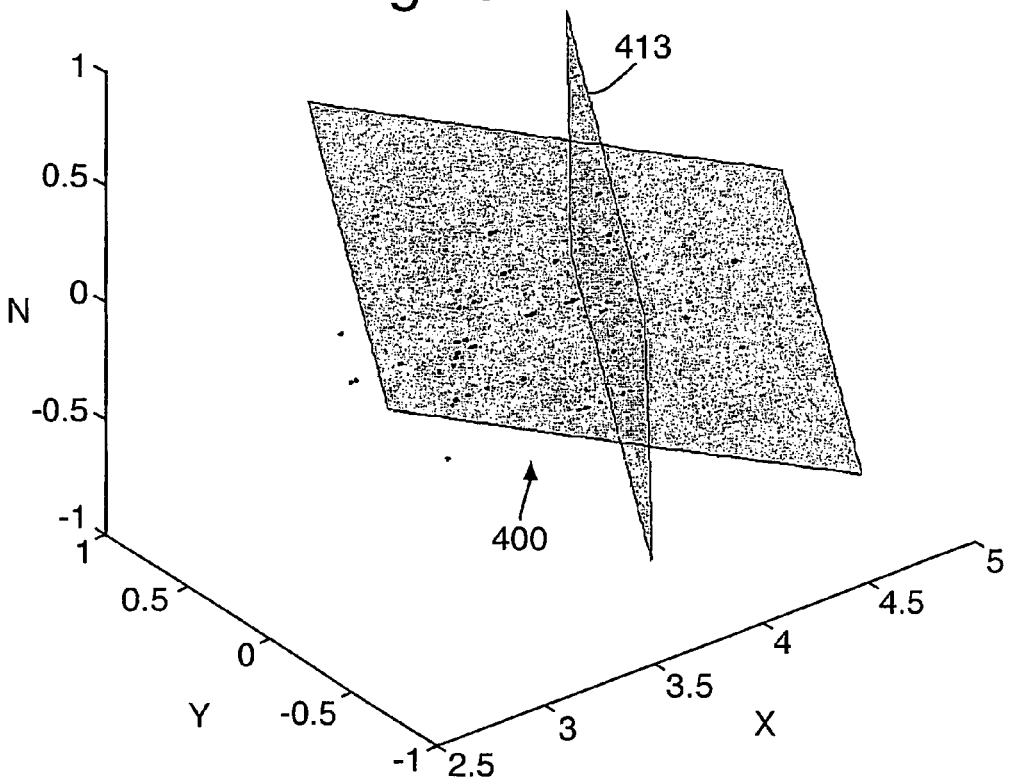
Figure 10C:
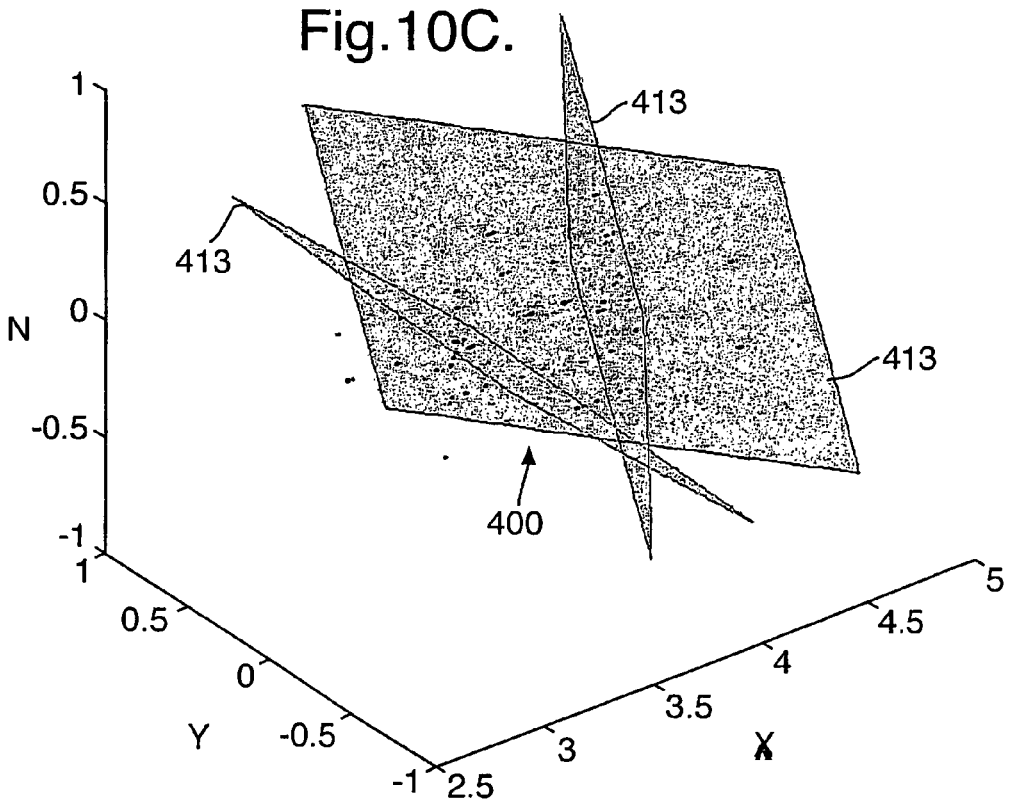
Figure 10D:
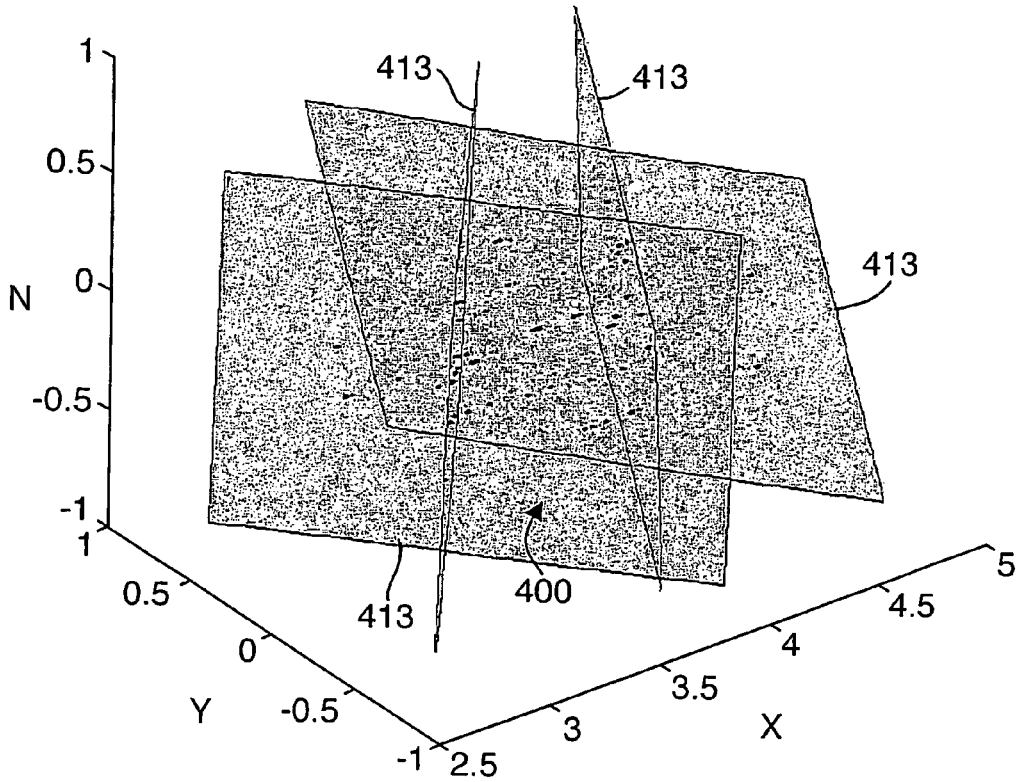
Figure 10E:
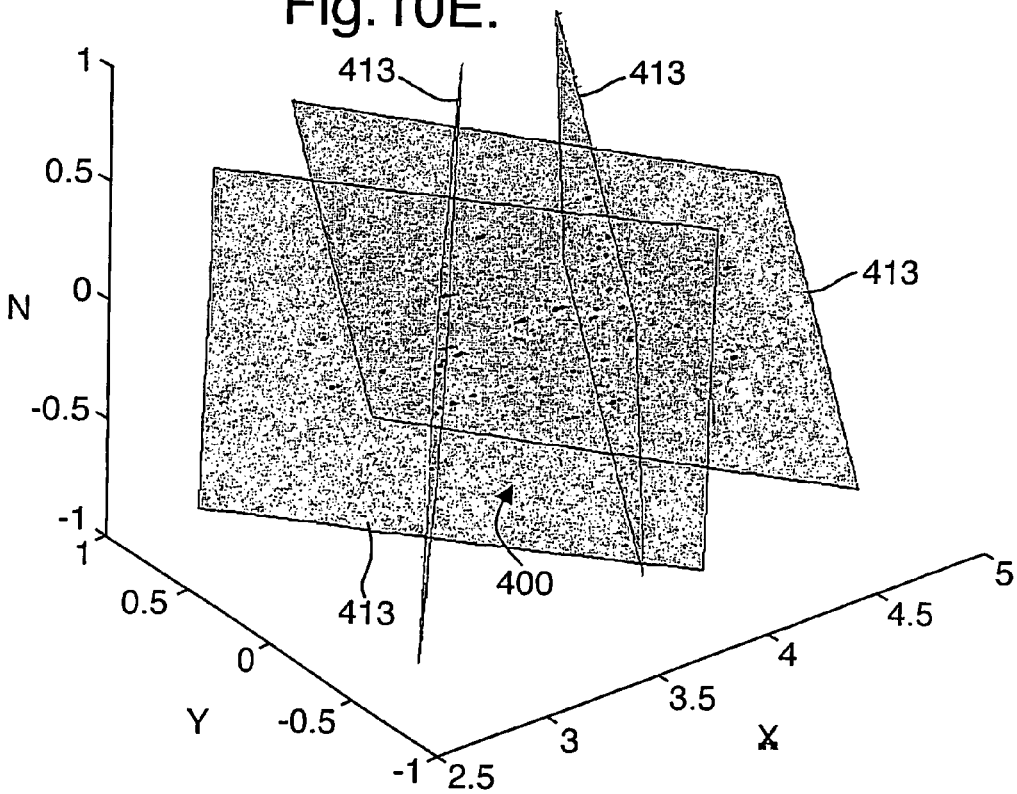

FIG. 10 shows the results of applying the incremental RFCV algorithm on the second precluster of FIG. 2 using c=1 (FIG. 10A) and c=2, . . . 5 (FIGS. 10B, . . . . 10E, respectively). In the case of c=3 (FIG. 10C) the method converges onto an artifact. As the number of clusters is further increased to c=4 and c=5 (FIGS. 10D, E) this cluster disappears and the four correctly recognized reflectors are recognized in the data. No further cluster is identified. The clusters are indicated by planes 413 drawn into the data space, which in turn is indicated by black dots 400 representing the impulse response of the microphone to the emitted sequences.

As in an automated set-up procedure the microphone position may be an unknown, any cluster identified according to the steps above, can be used to solve with standard algebraic methods equation [2] for the microphone position xmic, ymic and zmic.

With the microphone position and the distance and orientation of images of the transducer array known enough information is known about the room configuration to direct beams at the listeners from a variety of angles. This is done be reversing the path of the acoustic signal and directing a sound beam at each microphone image.

However, it is necessary to deduce the direction from which the beam appears to arrive at the listener.

One way of making this deduction is to decide from which walls the beam is being reflected in order to arrive at the microphone. If this decision is to be made automatically then it can be for most cases assumed that the walls are all flat and reflective over their whole surfaces. This implicitly means that the secondary reflection of surfaces A and B arrives at the microphone later than the primary reflected signals from surface A and from surface B, which permits the following algorithm:

1. Start by initializing an empty list of walls.
2. Take each microphone image in order of their distances from the DSP and search through all combinations of walls in the list to see if any composition of reflections in those walls could result in the microphone image being in the right place.
3. If such a combination does not exist then this microphone image is formed by a primary reflection in an as-yet-undiscovered wall. This wall is the perpendicular bisector of the line segment from the microphone image to the real microphone. Add the new wall to the list.

A more robust method comprises the use of multiple microphones or one microphone positioned at two or more different locations during the measurement and determining the perceived beam direction directly.

Using an arrangement with 4 microphones in a tetrahedral arrangement and after having determined the positions of images of each of the microphones individually they can be grouped into images of the original tetrahedron which will fully specify the perceived beam direction. If the walls are planar then the transformation mapping the real tetrahedron to its image will be an isometry and its inverse equivalently maps the Sound Projector to its perceived position from the listener's point of view.

Using less than four microphones results in an increase of uncertainty in the direction of the arrival. However in some case it is possible to use reasonable constraints, for example, such as that wall are vertical etc, to reduce this uncertainty.

The problem of scanning for a microphone image is a 2-dimensional search problem. It can be reduced to two consecutive 1-dimensional search problems using the beam projectors ability to generate various beam patterns. For example it is feasible to vary the beam shape to a tall, narrow shape and scanning horizontally, and then use a standard point-focused beam to scan vertically.

With a normal point-focused beam the wavefront of the impulse is designed to be spherical, centered on the focal point. If the sphere were replaced with an ellipsoid, stretched in the vertical direction, then the beam will become defocused in the vertical direction and form a tall narrow shape.

Alternatively, it is possible to form a tall narrow beam by using two beams focused at two points in space above one another and the same distance away from the Sound Projector. This is due to the abrupt change of phase between sidelobes and the large size of the main beam in comparison with the sidelobes.

Figure 11:
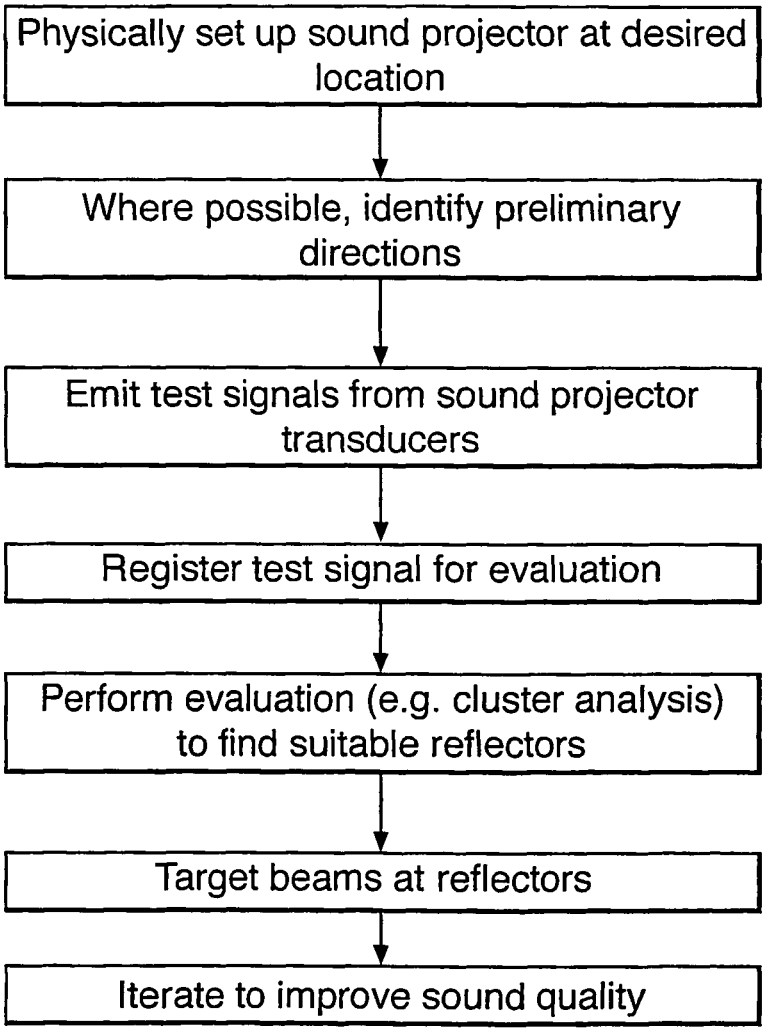
FIG. 11 summarizes the general steps of a method in accordance with the invention.

The general steps of the above-described method are summarized in FIG. 11.

Please note that the invention is particularly applicable to surround sound systems used indoors i.e. in a room. However, the invention is equally applicable to any bounded location which allows for adequate reflection of beams. The term "room" should therefore be interpreted broadly to include studio, theatres, stores, stadiums, amphitheatres and any location (internal or external) that allows the invention to operate.

We claim:

1. A set-up method for a surround sound loudspeaker system capable of generating at least one directed beam of audio sound, the surround sound loudspeaker system being in a room and comprising an array of electro-acoustic transducers, the room comprising a listening position, the method comprising:

emitting directional beams of set-up sound signals from the array of electro-acoustic transducers into the room;

registering at least one reflection of the emitted beams at one or more locations within the room; and evaluating the registered reflections to obtain data for use in configuring the surround sound loudspeaker system.

2. The method of claim 1, wherein each signal is emitted from a plurality of electro-acoustic transducers in the array so that the beam is emitted in a desired direction.

3. The method of claim 1, wherein different signals are simultaneously emitted from different electro-acoustic transducers.

4. The method of claim 3, wherein the different electro-acoustic transducers are located at one or both of an edge position and the centre of the transducer array.

5. The method of claim 3, wherein the beams are emitted as spatially constrained beams of sound to a range of directions, the spatially constrained beams of sound being laterally constrained to form narrow vertical beams.

6. The method of claim 5, wherein the spatially constrained beams of sound are laterally and vertically constrained to form narrow point or ellipsoidal beams.

7. The method of claim 1, wherein the registering includes positioning at least one microphone in the room and recording the at least one of the reflections using the at least one microphone.

8. The method of claim 7, wherein the at least one microphone comprises a plurality of microphones arranged in a known geometric configuration.

9. The method of claim 8, wherein the known geometric configuration is a tetrahedral configuration.

10. The method of claim 7, wherein the at least one microphone is physically positioned in or on the surround sound loudspeaker system.

11. The method of claim 7, wherein the at least one microphone is positioned at or near the plane of the array of electro-acoustic transducers.

12. The method of claim 11, wherein the at least one microphone is positioned at or near the centre of the array of electro-acoustic transducers.

13. The method of claim 1, wherein the evaluating includes determining the listening position relative to a location of the surround sound loudspeaker system.

14. The method of claim 1, wherein the evaluating includes identifying multiple acoustic paths to the listening position.

15. The method of claim 14, wherein the evaluating further includes assigning different audio channels to different paths.

16. The method of claim 1, wherein the evaluating includes identifying clusters of reflections in the registered reflections.

17. The method of claim 1, further comprising using pre-known data relating to the geometry of the room to exclude beam directions.

18. The method of claim 17, wherein the pre-known data are provided by a human operator, the method further including prompting for the input of the pre-known data.

19. The method of claim 17, wherein the pre-known data are provided by a previous application of a set-up method.

20. The method of claim 1, wherein the evaluating comprises recording the time elapsed between emitting the beams and receiving a first reflection at a location within the room.

21. The method of claim 1, wherein the evaluating comprises determining the distance of surfaces from the surround sound loudspeaker system by scanning set-up sound beams around the room.

22. The method of claim 1, wherein only a first predetermined portion of the registered reflections is evaluated in the evaluating.

23. The method of claim 1, wherein the beams emitted from the array of electro-acoustic transducers are focused such that the focus point is near to an estimated reflection surface.

24. The method of claim 23, further comprising using a feedback loop to provide that the beam focus tracks the estimated reflection surface position as the beam moves.

25. The method of claim 1, wherein at least one of the registered reflections is multiplied by a phase shifted version of the emitted beam to which it corresponds so as to discriminate beams reflected by surfaces that lie a predetermined distance from the array of electro-acoustic transducers.

26. The method of claim 1, wherein at least one of the beams emitted by the array of electro-acoustic transducers comprises a chirp signal.

27. The method of claim 26, further comprising using a matched filter to decode a reflected chirp signal to improve signal to noise ratio whilst maintaining adequate range-resolution.

28. The method of claim 26, wherein the chirp signal reduces in frequency during its duration.

29. The method of claim 1, wherein the evaluating includes determining the angle of reflective surfaces relative to the array of electro-acoustic transducers by analysing time of receipt of a plurality of reflections, each representing a first reflection of a corresponding emitted beam.

30. The method of claim 1, wherein the evaluating includes determining the angle of reflective surfaces relative to the array of electro-acoustic transducers by analysing relative amplitude of a plurality of reflections, each representing a first reflection of a corresponding emitted beam.

31. The method of claim 1, wherein the evaluating comprises analysing a change in received first reflection signal amplitude and analysing a change in time of the first reflection signal amplitude to determine whether a reflecting surface is continuous, planar or curved.

32. The method of claim 1, wherein the direction of beams emitted from the array of electro-acoustic transducers is set to track detected discontinuities between reflective surfaces in the room.

33. The method of claim 32, wherein the direction of beams emitted by the array of electro-acoustic transducers is caused to veer to one side of an estimated discontinuity to confirm the presence of the discontinuity in the reflective surfaces.

34. The method of claim 1, wherein the evaluating evaluates presence of a hole in a room surface in a particular direction when no reflected beam is registered following an emission of a beam from the array of electro-acoustic transducers and it is thereafter determined that audio sound beams are not directed towards the hole.

35. The method of claim 1, wherein the surround sound loudspeaker system is for playback of surround sound channels.

36. The method of claim 1, wherein the registered reflections are evaluated to determine directing parameters for use in directing a future beam of audio sound.

37. The method of claim 36, wherein the emitted beams are also registered and evaluated to determine the directing parameters.

38. The method of claim 36, further comprising:

using the directing parameters to direct the future beam of audio sound into a desired direction.

39. A surround sound system comprising:

an array of electro-acoustic transducers for emitting directional beams of set-up sound signals;

means for registering at least one reflection of the emitted beams at one or more locations within a room; and means for evaluating the registered reflections to obtain data for use in configuring the surround sound system.

40. The system of claim 39, wherein the means for evaluating comprises a signal processor that outputs time of first reflection of an emitted beam and/or amplitude of the reflection relative to the corresponding emitted beam.

41. The system of claim 39, wherein the system is configured to firstly determine positions of the major reflecting surfaces in the room and thereafter to determine directions in which surround sound channels will be emitted.

42. The system of claim 39, wherein the means for registering comprises at least one microphone.

43. The system of claim 42, wherein the at least one microphone is positioned in the surround sound system close to the array of electro-acoustic output transducers.

44. A surround sound system for a room comprising:

an array of electro-acoustic transducers configured to emit directional beams of sound signals;

controller electronics configured to control the array of electro-acoustic transducers to emit directional beams of set-up sound signals in different directions; and a detector configured to detect reflections of the set-up sound beams at one or more locations within the room, wherein the controller electronics is further configured to generate, based at least in part on the detected reflections, surround sound system configuration data usable in steering directional beams for surround sound channels.

45. The surround sound system according to claim 44, wherein the controller electronics is configured to generate the surround sound configuration data based on earliest reflections of the set-up sound beams.

46. The surround sound system according to claim 44, further comprising:

a signal processor configured to determine time lapses between the emitting of set-up sound beams and the detecting of their respective earliest reflections by the detector, and amplitudes of the respective earliest reflections, and wherein the controller electronics is further configured to determine room shape based on the determined time lapses and amplitudes and to generate the surround sound system configuration data based on the determined room shape.

* * * * *

UNITED STATES PATENT AND TRADEMARK OFFICE

CERTIFICATE OF CORRECTION

PATENT NO. : 8,594,350 B2
APPLICATION NO. : 10/540255
DATED : November 26, 2013
INVENTOR(S) : Hooley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2480 days.

Signed and Sealed this
Twenty-second Day of September, 2015

Michelle K. Lee

Michelle K. Lee
*Director of the United States Patent and Trademark Office*